US006338319B1

(12) United States Patent
Vago

(10) Patent No.: US 6,338,319 B1
(45) Date of Patent: Jan. 15, 2002

(54) WATER HEATER WITH FLAMMABLE VAPOR FLAME ARRESTOR AND METHOD OF OPERATION

(75) Inventor: Otto Z. Vago, Burns, TN (US)

(73) Assignee: Water Heater Industry Joint Research & Development, Reston, VA (US)

( * ) Notice: Subject to any disclaimer, the term of this patent is extended or adjusted under 35 U.S.C. 154(b) by 0 days.

(21) Appl. No.: 09/439,323

(22) Filed: Nov. 12, 1999

(51) Int. Cl.[7] ..... F22B 5/04
(52) U.S. Cl. ..... 122/13.01; 122/17.1; 431/346
(58) Field of Search ..... 122/13.01, 14.1, 122/14.21, 14.31, 17.1; 126/350.1; 431/346

(56) References Cited

U.S. PATENT DOCUMENTS 4,924,816 A * 5/1990 Moore, Jr. et al. ..... 122/14.1
5,415,233 A * 5/1995 Roussakis et al. ..... 431/346
5,435,716 A * 7/1995 Joyce ..... 122/17.1
5,588,822 A * 12/1996 Hayakawa et al. ..... 431/346
5,791,298 A * 8/1998 Rodgers ..... 122/17.1
5,794,707 A * 8/1998 Alhamad ..... 169/69
5,797,355 A * 8/1998 Bourke et al. ..... 122/13.01
5,941,200 A * 8/1999 Boros et al. ..... 122/13.01

* cited by examiner

*Primary Examiner*—Gregory Wilson
(74) *Attorney, Agent, or Firm*—Sughrue Mion, PLLC

(57) ABSTRACT

A water heater having a water-tight tank and a sealed combustion chamber in which the fuel burner is mounted. A flame arrestor is mounted in the bottom wall of the combustion chamber. The arrestor functions to allow combustion air to flow from the atmosphere into the water heater combustion chamber and further functions to prevent flashback through the arrestor caused by the addition of a flammable material which may have been spilled in the area in which the heater is installed. This function of the arrestor is due to the provision of a pressure drop between the inlet and outlet faces of the arrestor sufficient to prevent a flashback of burning gasoline or other flammable material. The arrestor is of sufficient mass so as to function as a heat sink to thereby prevent the heat in the combustion chamber from passing through the arrestor by conduction to a degree sufficient to cause ignition of a flammable material located exteriorly of the combustion chamber.

22 Claims, 1 Drawing Sheet

WATER HEATER WITH FLAMMABLE VAPOR FLAME ARRESTOR AND METHOD OF OPERATION

CROSS-REFERENCE TO RELATED APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

Gas-fired residential and commercial water heaters are generally formed to include a vertical cylindrical water storage tank with a gas burner disposed in a combustion chamber below the tank. The burner is supplied with a fuel gas through a gas supply line and combustion air through one or more air inlet openings providing communication between ambient air and the interior of the combustion chamber.

Water heaters of this general type are extremely safe in operation. However, when gasoline or other flammable liquids are stored or used improperly in proximity to the water heater, there may exist a possibility of flammable vapors becoming entrained in the air intake of the water heater. It is accordingly possible for the resulting flame to propagate out of the combustion chamber into the ambient environment around the water heater as a result of following the intake path of the flammable vapor. Under such conditions, a fire and/or explosion may occur. The present invention relates to a gas-fired water heater design where the danger of such a fire or explosion referred to above is greatly reduced or completely eliminated.

BRIEF SUMMARY OF THE INVENTION

A water heater having a sealed combustion chamber with a fuel burner mounted therein. A flame arrestor is mounted in the bottom wall of the combustion chamber. The arrestor is comprised of continuous spiral wound layers of a flat material and a corrugated material sandwiched between layers of the flat material. The honeycomb construction provides a plurality of air passage cells, which extend from one surface of the arrestor to the opposite surface of the arrestor. The height of the arrestor is relatively long compared to the cross-sectional areas of the air passage cells. The arrestor functions to allow combustion air to flow from the atmosphere into the combustion chamber. The arrestor is further adapted to prevent flashback back through the arrestor to thereby prevent ignition of flammable liquids, which may have become spilled in the area in which the water heater is installed. The arrestor is of sufficient mass so as to function as a heat sink to thereby prevent the heat in the combustion chamber from passing through the arrestor by conduction to a temperature degree sufficient to cause ignition of a flammable liquid located exteriorly of the combustion chamber.

DETAILED DESCRIPTION OF THE INVENTION

Figure 1:
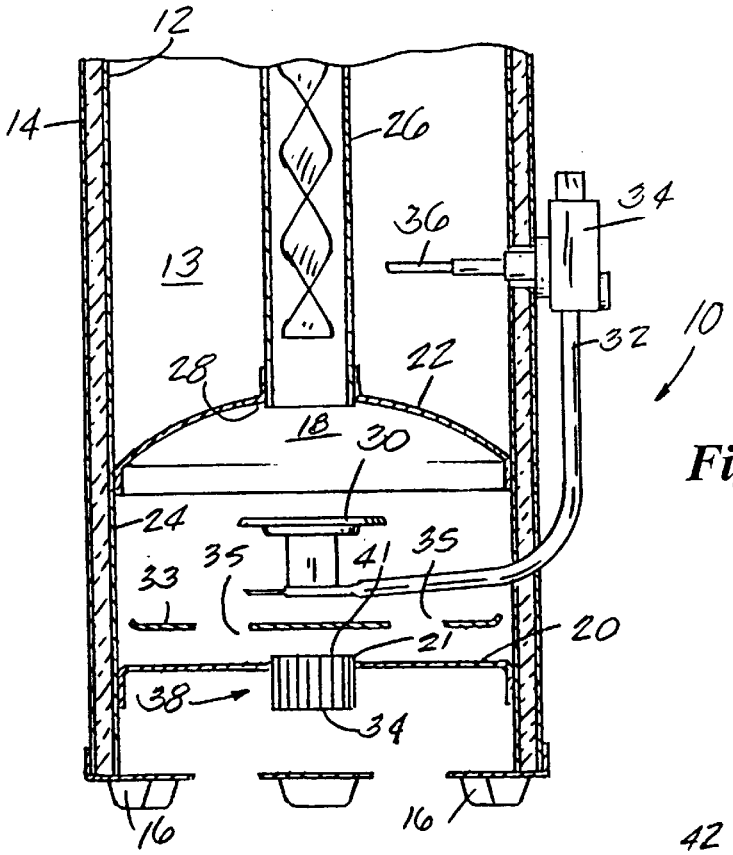
FIG. 1 is a partial cross-sectional side elevation view of a water heater with a flame arrestor mounted in the wall of the water heater combustion chamber.

Referring to FIG. 1, the water heater 10 of the present invention is comprised of a watertight tank shell 12 having an outer jacket 14 spaced from the shell. Tank shell 12 contains the water to be heated in interior 13 of the tank.

The space between the tank shell 12 and jacket 14 is filled with a suitable insulation material (not shown).

The water heater 10 is supported on a plurality of leg members 16.

A sealed combustion chamber 18 is located immediately beneath tank shell 12. Chamber 18 is comprised of a bottom wall 20 and a top wall 22 fastened to the inside surface of the tank shell wall 12 by welding or other suitable means. Walls 20 and 22 and the lower wall portion 24 of tank shell wall 12 together serve to provide the sealed combustion chamber 18. A flue gas tube 26 is mounted and sealed by welding in an opening 28 in the top wall 22 of the combustion chamber 18.

A gas-fired burner 30 of conventional construction is mounted in combustion chamber 18. A fuel oil fired burner could be used as an alternative. Gas to burner 30 flows through a tube 32 under the control of a thermostatically controlled valve 34, also of conventional construction. A heat sensor member 36 extends into the water in the interior 13 of tank shell 12 and functions to control operation of thermostatic valve 34, which, in turn, functions to control the flow of gas to burner 30. A partition 33 with openings 35 is mounted in combustion chamber 18 between the bottom wall 20 of the combustion chamber 18 and the gas-fired burner 30. Openings 35 are located outside of the circumferential edge of burner 30.

A flame arrestor member 38 is mounted in a combustion air opening 21 in bottom wall 20 of combustion chamber 18 and is fastened in wall 20 by welding or other suitable means.

As shown in FIG. 1, flame arrestor 38 is mounted in wall 20 of the combustion chamber in a location wherein the major portion of the arrestor extends downwardly from wall 20 below combustion chamber 18. In a preferred embodiment, the arrestor 38 is located so that the top 41 of the arrestor is substantially at the level of wall 20, i.e., with the top 41 flush with the wall 20. The reason for this relationship will be explained hereinafter.

Figure 3:
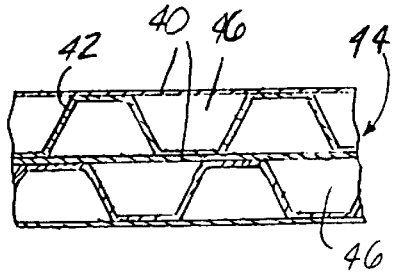
FIG. 3 is an enlarged fragmentary top view of the encircled area shown in FIG. 2.
Figure 2:
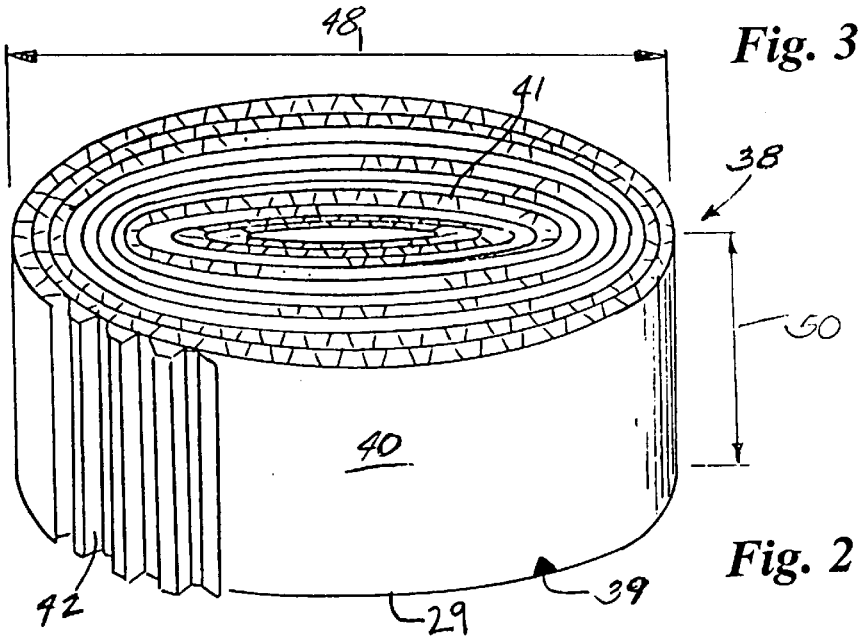
FIG. 2 is a side elevation perspective view of the flame arrestor shown in FIG. 1 with parts broken away.

While the detailed construction of arrestor 38 can vary, one preferred embodiment is shown in FIGS. 2 and 3. The arrestor 38 can be described generally as having a honeycomb construction.

More specifically, as shown in FIGS. 2 and 3, the arrestor is comprised of continuous spiral wound layers of a flat material 40 and a corrugated material 42 sandwiched between layers of the flat material 40. The resulting honeycomb construction 44 is clearly shown in FIGS. 2 and 3.

As shown in FIGS. 2 and 3, the honeycomb construction 44 is comprised of layers of flat material 40 and corrugated material 42 which provide a plurality of air passageway cells 46 which extend from one surface 29 of the arrestor 38 to the opposite surface 41 of the arrestor 38.

The air passageway cells 46 shown in FIG. 3 are of a trapezoidal cross-sectional shape. The cells could also have a variety of shapes, such as square, rectangular, triangular, etc.. The cross-sectional area of cells 46 is in the range of 0.0031 to 0.375 square inches. In one preferred embodiment, the corrugated material 42 has dimensions of 1.25, 1.00 and 2.75 millimeters as shown in FIG. 3.

In a typical embodiment, i.e., a water heater having a BTU/HR input of 40,000 BTU, arrestor 38 will have a diameter 48 of approximately six (6) inches and a height of 50 (thickness) of approximately two (2) inches. As indicated, the height 50 of the arrestor 38 is relatively long compared to the cross-sectional areas of passageway cells 46.

The material of flame arrestor 38 can be metallic, such as stainless steel or non-metallic, such as a high temperature resistant ceramic.

Operation

When flammable fluid such as gasoline (paint thinner, cleaning fluid, etc.) is spilled in the area in which the heater is installed, the pilot or main burner of a conventional water heater, i.e., a water heater without a sealed combustion chamber 18 and a flame arrestor 38, may cause the gasoline vapors to ignite, resulting in a fire and/or explosion to occur in the space in which the water heater is installed.

The water heater 10 of the present invention operates as follows. When heat sensor member 36 calls for heat, thermostatically controlled valve 34 opens to allow a flow of gas fuel to flow through tube 32 to burner 30. A pilot burner (not shown) will ignite the gas fuel at the burner 30.

In the water heater 10 of the present invention, outside combustion air flows into combustion chamber 18 through the air passageway cells 46 of arrestor 38. The air entering chamber 18 supports combustion of the gas fuel at burner 30 to thereby heat the water in the interior 13 of tank 12.

If gasoline is spilled in the area in which the heater is installed, gasoline vapor passing through arrestor 38 into combustion chamber 30 will be burned up inside the chamber. Due to the pressure drop between the inlet face 39 and the outlet face 41 of arrestor 38, a flashback of burning gasoline vapor is prevented, i.e., the relatively long and narrow passageway cells 46 will prevent burning gasoline vapor from backfiring out of the inlet face 39 of arrestor 38.

The mass of the flame arrestor 38 is of a sufficient magnitude so as to cause the flame arrestor 38 to function as a heat sink. This heat sink effect will prevent the heat in the combustion chamber from passing through the material of arrestor 38 by conduction to a degree sufficient to reach the ignition temperature of a flammable material such as gasoline located exteriorly of the combustion chamber 18.

Thus, the combined pressure drop effect and heat sink effect provided by the arrestor 38 functions to prevent ignition of gasoline vapor exteriorly of the water heater combustion chamber.

While the invention herein has been shown and described in what is presently conceived to be the most practical preferred embodiment, it will be obvious to one of ordinary skill in the art that many modifications may be made thereof within the scope of the invention, which scope is not to be limited except by the appended claims.

I claim:

1. A water heater comprising:

(a) a watertight tank (12);

(b) a sealed combustion chamber (18) having a flue gas tube (26) sealed to the top wall (22) of said combustion chamber (18) and a combustion air opening (21) in a wall of the combustion chamber (18);

(c) a fuel burner (30) mounted in said combustion chamber (18);

(d) a flame arrestor (38) mounted in said combustion air opening (21) of said combustion chamber (18), said flame arrestor (38) having a honeycomb design with a plurality of air passage cells (46) extending from one face of said arrestor to the opposite face of said arrestor, each of said passage cells having a length which is relatively long with respect to the cross-sectioned area of said air passage cells (46), said flame arrestor (38) functioning to allow combustion air to flow from the atmosphere into the water heater combustion chamber (18) to support the burning of fuel emanating from the burner (30), said flame arrestor (38) further adapted to prevent flashback through the flame arrestor of flammable vapor which may be carried into the combustion chamber through the flame arrestor from the exterior space adjacent the combustion chamber.

2. A water heater according to claim 1 in which said flame arrestor (38) is of sufficient mass so as to function as a heat sink to thereby prevent the heat in the combustion chamber (18) from passing through the flame arrestor (38) by conduction to a degree sufficient to reach the ignition temperature of flammable vapor located exteriorly of combustion chamber (18), said arrestor having a circular shape and having a diameter of approximately 6 inches and a height of approximately 2 inches.

3. A water heater according to claim 1 in which said flame arrestor(38) is comprised of layers of a flat material (40) and a corrugated material (42) sandwiched between layers of the flat material (40).

4. A water heater according to claim 3 in which said layers of flat material and corrugated material are wound in a spiral pattern.

5. A water heater according to claim 1 in which said air passage cells (46) have a cross-sectional area in the range of 0.0031 to 0.375 square inches.

6. A water heater according to claim 1 in which said fuel is gas.

7. A water heater according to claim 1 in which said fuel is fuel oil.

8. A water heater according to claim 1 in which the material of said arrestor is stainless steel.

9. A water heater according to claim 1 in which said flame arrestor (38) is a heat sink that prevents the heat in the combustion chamber (18) from passing through the flame arrestor (38) by conduction to a degree sufficient to reach the ignition temperature of flammable vapor located exteriorly of the combustion chamber (18).

10. The method of preventing ignition of a flammable vapor in the exterior space adjacent the combustion chamber of a fuel-fired water heater (10) having a combustion chamber (18) with a fuel burner (30) mounted in the combustion chamber, comprising the steps of:

(a) providing a sealed combustion chamber (18) having a flue gas tube (26) sealed to the top of the combustion chamber and a combustion air opening (21) in a wall of the combustion chamber;

(b) mounting a flame arrestor (38) in the combustion air opening (21), said flame arrestor (38) is of a honeycomb design having a plurality of air passage cells (46) extending through the arrestor to permit flow of combustion air into the combustion chamber (18) from the atmosphere, said flame arrestor (38) functioning to allow combustion air to flow from the atmosphere into the water heater combustion chamber (18) to support the burning of fuel emanating from the burner (30); and (c) said air passage cells having a length which is relatively long with respect to the cross-sectional area of said air passage cells so that the pressure drop across each passage cell is sufficient to prevent any flashback through the flame arrestor caused by the ignition of flammable material which is carried into the combustion chamber through the flame arrestor from the exterior space adjacent the combustion chamber.

11. The method of claim 10 in which the flame arrestor (38) is a heat sink that prevents the heat in the combustion chamber (18) from passing through the flame arrestor (38) by conduction to a degree sufficient to cause ignition of a flammable vapor located exteriorly of the combustion chamber (18).

12. The method of claim 10 in which said air passage cells (46) have a cross-sectional area in the range of 0.0031 to 1.00 sq.

13. The method of claim 10 in which said flame arrestor (38) is comprised of layers of a flat material (40) and a corrugated material (42) sandwiched between layers of the flat material (40).

14. The method of claim 13 in which said layers of flat material and corrugated material are wound in a spiral pattern.

15. A water heater comprising:

(a) a watertight tank (12):

(b) an sealed combustion chamber (18) having a flue gas tube (26) sealed to the top wall (22) of said combustion chamber (18) and a combustion air opening (21) in a wall of the combustion chamber (18);

(c) a fuel burner (30) mounted in said combustion chamber (18);

(d) a flame arrestor (38) mounted in said combustion air opening (21) of said combustion chamber (18), said flame arrestor (38) having a honeycomb design with a plurality of air passage cells (46) extending from one face of said arrestor to the opposite face of said arrestor, each of said passage cells having a length which is relatively long with respect to the cross-sectioned area of said air passage cells (46), said flame arrestor (38) functioning to allow combustion air to flow from the atmosphere into the water heater combustion chamber (18) to support the burning of fuel emanating from the burner (30), said flame arrestor (38) further adapted to prevent flashback through the flame arrestor of flammable vapor which may be carried into the combustion chamber through the flame arrestor from the exterior space adjacent the combustion chamber, said arrestor being of circular configuration having a diameter of approximately 6 inches and a height of approximately 2 inches.

16. A water heater comprising:

(a) a watertight tank (12);

(b) an sealed combustion chamber (18) having a flue gas tube (26) sealed to the top wall (22) of said combustion chamber (18) and a combustion air opening (21) in a wall of the combustion chamber (18);

(c) a fuel burner (30) mounted in said combustion chamber (18);

(d) a flame arrestor (38) mounted in said combustion air opening (21) of said combustion chamber (18), said flame arrestor (38) having a honeycomb design with a plurality of air passage cells (46) extending from one face of said arrestor to the opposite face of said arrestor, each of said passage cells having a length which is relatively long with respect to the cross-sectioned area of said air passage cells (46), said flame arrestor (38) functioning to allow combustion air to flow from the atmosphere into the water heater combustion chamber (18) to support the burning of fuel emanating from the burner (30), said flame arrestor (38) further adapted to prevent flashback through the flame arrestor of flammable vapor which may be carried into the combustion chamber through the flame arrestor from the exterior space adjacent the combustion chamber, said arrestor is mounted in said opening (21) of said combustion chamber at a location wherein the top surface (41) of the arrestor is substantially at the level of the combustion chamber wall (20) in which said arrestor is mounted.

17. A water heater comprising:

(a) a watertight tank (12);

(b) an sealed combustion chamber (18) having a flue gas tube (26) sealed to the top wall (22) of said combustion chamber (18) and a combustion air opening (21) in a wall of the combustion chamber (18);

(c) a fuel burner (30) mounted in said combustion chamber (18);

(d) a flame arrestor (38) mounted in said combustion air opening (21) of said combustion chamber (18), said flame arrestor (38) having a honeycomb design with a plurality of air passage cells (46) extending from one face of said arrestor to the opposite face of said arrestor, each of said passage cells having a length which is relatively long with respect to the cross-sectioned area of said air passage cells (46), said flame arrestor (38) functioning to allow combustion air to flow from the atmosphere into the water heater combustion chamber (18) to support the burning of fuel emanating from the burner (30), said flame arrestor (38) further adapted to prevent flashback through the flame arrestor of flammable vapor which may be carried into the combustion chamber through the flame arrestor from the exterior space adjacent the combustion chamber, said water heater further characterized by having a partition (33) with openings (35) mounted in combustion chamber (18) between the bottom wall (20) of the combustion chamber (18) and the burner (30), said openings (35) located outside the circumferential edge of burner (30).

18. The method of preventing ignition of a flammable vapor in the exterior space adjacent the combustion chamber of a fuel-fired water heater (10) having a combustion chamber (18) with a fuel burner (30) mounted in the combustion chamber, comprising the steps of:

(a) providing a sealed combustion chamber (18) having a flue gas tube (26) sealed to the top of the combustion chamber and a combustion air opening (21) in a wall of the combustion chamber;

(b) mounting a flame arrestor (38) in the combustion air opening (21), said flame arrestor (38) is of a honeycomb design having a plurality of air passage cells (46) extending through the arrestor to permit flow of combustion air into the combustion chamber (18) from the atmosphere, said flame arrestor (38) functioning to allow combustion air to flow from the atmosphere into the water heater combustion chamber (18) to support the burning of fuel emanating from the burner (30); and (c) said air passage cells having a length which is relatively long with respect to the cross-sectional area of said air passage cells so that the pressure drop across each passage cell is sufficient to prevent any flashback through the flame arrestor caused by the ignition of flammable material which is carried into the combustion chamber through the flame arrestor from the exterior space adjacent the combustion chamber, said arrestor as recited above is mounted in said opening (21) of said combustion chamber at a location wherein the top surface (41) of the arrestor is substantially at the level of the combustion chamber wall (20) in which said arrestor is mounted.

19. A water heater comprising:

(a) a tank that holds water;

(b) a combustion chamber having a combustion air opening in a wall of said combustion chamber;

(c) a fuel burner mounted in said combustion chamber; and (d) a flame arrestor mounted in said combustion air opening;

wherein said flame arrestor has a honeycomb design with a plurality of air passage cells extending from one face of said flame arrestor to the opposite face of said flame arrestor, each of said passage cells having a length that is longer than the widest part of a cross-section of said cells;

wherein said flame arrestor allows combustion air to flow into said combustion chamber to support the burning of fuel emanating from said fuel burner; and wherein said flame arrestor prevents flashback through said flame arrestor of a flammable vapor.

20. A water heater according to claims 1 or 19, wherein said flame fuel burner is mounted independently from said flame arrestor.

21. A water heater according to claim 19, wherein said flame arrestor is mounted in said combustion air opening at a location wherein a top surface of said flame arrestor is substantially at a level of a combustion chamber wall in which said flame arrestor is mounted.

22. A water heater according to claims 1 or 19, wherein combustion air flows into said combustion chamber only through said flame arrestor.

* * * * *